US005957661A

United States Patent [19]

Hunt et al.

[11] Patent Number: 5,957,661

[45] Date of Patent: Sep. 28, 1999

[54] HIGH EFFICIENCY TO DIAMETER RATIO AND LOW WEIGHT AXIAL FLOW FAN

[75] Inventors: Alexander Graham Hunt; Hugo Capdevila; Bonifacio M. Castillo, all of London, Canada

[73] Assignee: Siemens Canada Limited, Mississauga, Canada

[21] Appl. No.: 09/097,972

[22] Filed: Jun. 16, 1998

[51] Int. Cl.[6] ..... B63H 1/16; B64C 11/00; F01D 5/22

[52] U.S. Cl. ..... 416/192; 416/223 R; 416/169 A; 416/192; 416/234; 416/237

[58] Field of Search ..... 416/223 R, 169 A, 416/192, 234, 237

[56] References Cited

U.S. PATENT DOCUMENTS

| | | | |
|---|---|---|---|
| 16,517 | 2/1857 | Marshall . | |
| 562,020 | 6/1896 | Peabody . | |
| 1,062,258 | 5/1913 | Schlotter . | |
| 1,408,715 | 3/1922 | Seelig et al. . | |
| 1,795,588 | 3/1931 | Wilson . | |
| 1,993,158 | 3/1935 | Funk . | |
| 2,154,313 | 4/1939 | McMahan . | |
| 2,219,499 | 10/1940 | Troller . | |
| 2,397,169 | 3/1946 | Troller et al. . | |
| 2,628,019 | 2/1953 | Koch . | |
| 2,687,844 | 8/1954 | Woodward . | |
| 3,168,235 | 2/1965 | Valdi . | |
| 3,173,604 | 3/1965 | Sheets et al. . | |
| 3,481,534 | 12/1969 | Price . | |
| 3,680,977 | 8/1972 | Rabouyt et al. . | |
| 3,995,970 | 12/1976 | Nobuyuki . | |
| 4,181,172 | 1/1980 | Longhouse . | |
| 4,329,946 | 5/1982 | Longhouse . | |
| 4,358,245 | 11/1982 | Gray . | |
| 4,396,351 | 8/1983 | Hayashi et al. . | |
| 4,459,087 | 7/1984 | Barge . | |
| 4,548,548 | 10/1985 | Gray, III . | |
| 5,184,938 | 2/1993 | Harmsen | 416/223 R |
| 5,244,347 | 9/1993 | Gallivan et al. . | |
| 5,326,225 | 7/1994 | Gallivan et al. | 416/179 |
| 5,399,070 | 3/1995 | Alizadeh . | |
| 5,769,607 | 2/1997 | Neely et al. | 416/189 |

FOREIGN PATENT DOCUMENTS

| | | |
|---|---|---|
| 29 13 922 | 10/1980 | Germany . |
| 1150409 | 4/1995 | Russian Federation . |

*Primary Examiner*—F. Daniel Lopez
*Assistant Examiner*—Rhonda Barton

[57] ABSTRACT

A high efficiency axial flow fan includes a hub, fan blades and a circular band. The hub rotates about a rotational axis when torque is applied from a shaft rotatably driven by a power source. The circular band is concentric with the hub, connected to the tip of each blade, and is spaced radially outward from the hub. The blades are configured to produce an airflow when rotated about the rotational axis. Each blade has a chord length distribution, stagger angle and dihedral distribution which varies along the length of the blade. The dihedral distance of each blade varies as a function of blade radius from the rotational axis.

26 Claims, 3 Drawing Sheets

HIGH EFFICIENCY TO DIAMETER RATIO AND LOW WEIGHT AXIAL FLOW FAN

FIELD OF THE INVENTION

The invention generally relates to axial flow fans for use in cooling systems. The invention particularly relates to a low noise, high efficiency, axial flow fan having an improved blade shape which minimizes the noise output of the fan while maintaining high efficiency with respect to air throughput and cooling.

BACKGROUND OF THE INVENTION

An axial flow fan may be used to produce a flow of cooling air through the heat exchanger components of a vehicle. For example, an airflow generator used in an automotive cooling application may include an axial flow fan for moving cooling air through an air-to-liquid heat exchanger such as an engine radiator, condenser, intercooler, or combination thereof. The required flow rate of air through the fan and change in pressure across the fan vary depending upon the particular cooling application. For example, different vehicle types or engine models may have different airflow requirements, and an engine or transmission cooler radiator may have different requirements than an air conditioner.

In general, when air moves axially through an unobstructed circular cylinder or tube, its flow is hindered mainly by friction from the wall of the cylinder. Thus, air moves faster down the center of a tube and slower in the concentric volumes closer to the tube's walls. The complexity of such air flow has been studied extensively. Even more complex is the flow of air through cylinders which have obstructions within them. Such obstructions may include motors as well as fan hubs and blades themselves. For example, axial flow, automotive cooling fans exhibit complex air flow because of the presence of passive components such as the motor and hub.

Specifically, both the fan blades and the hub, or the hub in combination with a drive motor and blades, are obstructions to the passage of air through the duct. The complexity of the flow is due largely to the interaction of the air with the bounding surfaces. For instance, the fan hub directs air radially outward into concentric volumes away from the center of rotation while the cylinder walls direct air toward the center of the duct. The fan blades direct air both axially through the duct, and circumferentially and radially outward toward the wall of the duct and into concentric volumes away from the center of rotation. Thus, in an axial flow fan, the concerted effect of the cylinder wall, fan blades and fan hub is to direct air into and move it through an annular "flow zone." The radial and circumferential flow of air in the cylinder also may increase turbulence in the duct.

To provide adequate cooling, a fan should have performance characteristics which meet the flow rate and pressure rise requirements of the particular automotive application. For example, some applications impose low flow rate and high pressure rise requirements while other applications impose high flow rate and low pressure rise requirements. The fan must also meet the dimensional constraints imposed by the automotive engine environment, as well as the power efficiency requirements with respect to the fan drive motor, which is typically electric.

Accordingly, there is a need for an improved fan for moving air in vehicle cooling systems with high efficiency and having a low weight as well as a high strength to weight ratio. There is similarly a need to provide an axial flow fan which has performance characteristics meeting the requirements imposed by various automotive applications. Further, it is desirable to provide a fan capable of covering a broad range of automotive applications.

SUMMARY OF THE INVENTION

The invention relates to a fan rotatable about a rotational axis including a plurality of radially-extending fan blades configured to produce an airflow when rotated about the rotational axis.

The invention also relates to a fan including a hub rotatable about a rotational axis and a plurality of fan blades extending radially and axially from the hub and configured to produce an airflow when rotated about the rotational axis. Each blade has a dihedral distribution and a chord length distribution both of which vary along the blade as a function of radius from the rotational axis.

Further, the invention relates to a fan including a hub rotatable about a rotational axis and a plurality of fan blades extending radially from the hub and configured to produce an airflow when rotated about the rotational axis. In some preferred embodiments of the invention, the fan blades extend both radially and axially from the hub in order to achieve desired efficiencies.

The invention also relates to a high efficiency, axial flow fan for producing an airflow through an engine compartment of a vehicle. The fan includes a hub rotatable about a rotational axis, a circular band concentric with the hub and spaced radially outward from the hub, and from two to twelve and, preferably, from eight to ten, and most preferably, nine, fan blades distributed circumferentially around the hub and extending radially from the hub to the circular band. With the disclosed combination of geometric aspects, fans according to the present invention possess a high strength to weight ratio, and move air with great efficiency.

As is shown in FIGS. 3 and 4, C, the chord length, is the straight-line distance between the beginning and end of a circular arc camber line, and is measured at R, the radial distance from the axis of rotation. $\xi$ is the stagger angle of a blade section, that is, the angle in degrees between the axis of rotation and the chord line. The blade is identified as having a leading edge and a trailing edge. The leading edge is the upstream edge of the blade and the trailing edge is the downstream edge of the blade. $\Theta$ is the camber angle, that is, the angle in degrees between a tangent to the camber line at the leading edge and a tangent to the camber line at the trailing edge of a blade section at the radial distance R.

$\Lambda$ is the skew angle of a blade chord section in degrees, measured with respect to a radius through the center of the fan at a blade hub root at the radial distance R, calculated at 30% chord, where the blade root position at the hub is defined as zero skew, and negative values of $d\Lambda/dR$ indicate a forward skew. h is the dihedral distance of the trailing edge of a blade, at a radial distance R, from a datum plane perpendicular to the axis of rotation at the upstream surface of the hub, and is used to determine the slope, dh/dR, of the dihedral measured between two adjacent values of R. Of course, one of ordinary skill in the art will recognize that slope may be measured in other manners, for example, with respect to other datum planes.

Each blade has substantially the parameters defined by a particular set of values for R (the radial distance from the rotational axis), C (the chord length of the blade at the radial distance R), $\xi$ (the stagger angle in degrees of a blade section at the radial distance R), $\Theta$ (the camber angle in degrees of a blade section at the radial distance R), Λ (the skew angle of a blade chord section in degrees, at the radial distance R, calculated at 30% chord, where the blade root position at the hub is defined as zero skew, and negative values of dΛ/dR indicate a forward skew), h (the dihedral distance of the downstream edge of the blade, at the radial distance R, from a plane perpendicular to the axis of rotation at the upstream surface of the hub), and dh/dR (the slope of the dihedral measured between two adjacent values of R).

In addition, the invention relates to a vehicle cooling system including a heat exchanger, such as an engine coolant radiator or air conditioner heat exchanger, configured to transfer heat from a vehicle system, and a powered fan configured to move air through the heat exchanger. The fan includes fan blades which extend radially and axially and are configured to produce an airflow when rotated about a rotational axis.

In accordance with these aspects of the invention, a fan rotatable about a rotational axis is provided, the fan comprising a hub rotatable around the axis wherein the hub comprises an upstream surface and a circumferential surface, and a plurality of fan blades extending radially from the circumferential surface of the hub, the hub and blades being configured to produce an airflow when rotated about the axis, each blade having a chord length distribution, stagger angle and dihedral distance which varies along the length of the blade, each blade extending axially downstream from the upstream surface of the hub, wherein each blade joins a circular band concentric with the hub and spaced radially outward from the hub, the circular band comprising an upstream edge disposed axially downstream from the upstream surface of the hub, and wherein the rate of change of the dihedral distance of the trailing edge of each blade with respect to a radius of each blade is substantially between 0.0 and −0.462. Furthermore, the fan preferably is configured so that the leading edge of each blade joins the circular band downstream from the upstream edge of the band.

A fan according to some aspects of the present invention preferably has from 2 to 12 blades, and the blades are spaced evenly or unevenly around the circumferential portion of the hub. In addition, the circular band of a fan according to the present invention has an L-shaped cross-section taken along a plane passing through the rotational axis. In addition, a fan according to the present invention is provided preferably in combination with a duct, the circular band being operatively disposed within the duct such that, when the fan is rotated within the duct, a labyrinth (or "aeromechanical") seal is formed. In accordance with another aspect of the present invention, the hub, blades and circular band are an integral piece. By "integral," is meant that the fan blades, hub and circular band are formed, forged or molded in one piece.

BRIEF DESCRIPTION OF THE DRAWINGS

The invention will be better understood from the following detailed description of the preferred embodiments thereof, taken in conjunction with the accompanying drawings, wherein like reference numerals refer to like parts, in which.

DETAILED DESCRIPTION OF THE PREFERRED EMBODIMENTS

The following is a detailed description of a specific embodiment of a fan according to the invention, and ranges of parameters regarding several fans according to the present invention. Embodiments of the fans are shown in FIGS. 1–4. It should be understood that alternative embodiments, particularly those which fall within the ranges of parameters disclosed, may be adapted or selected for use in various applications.

Figure 1:
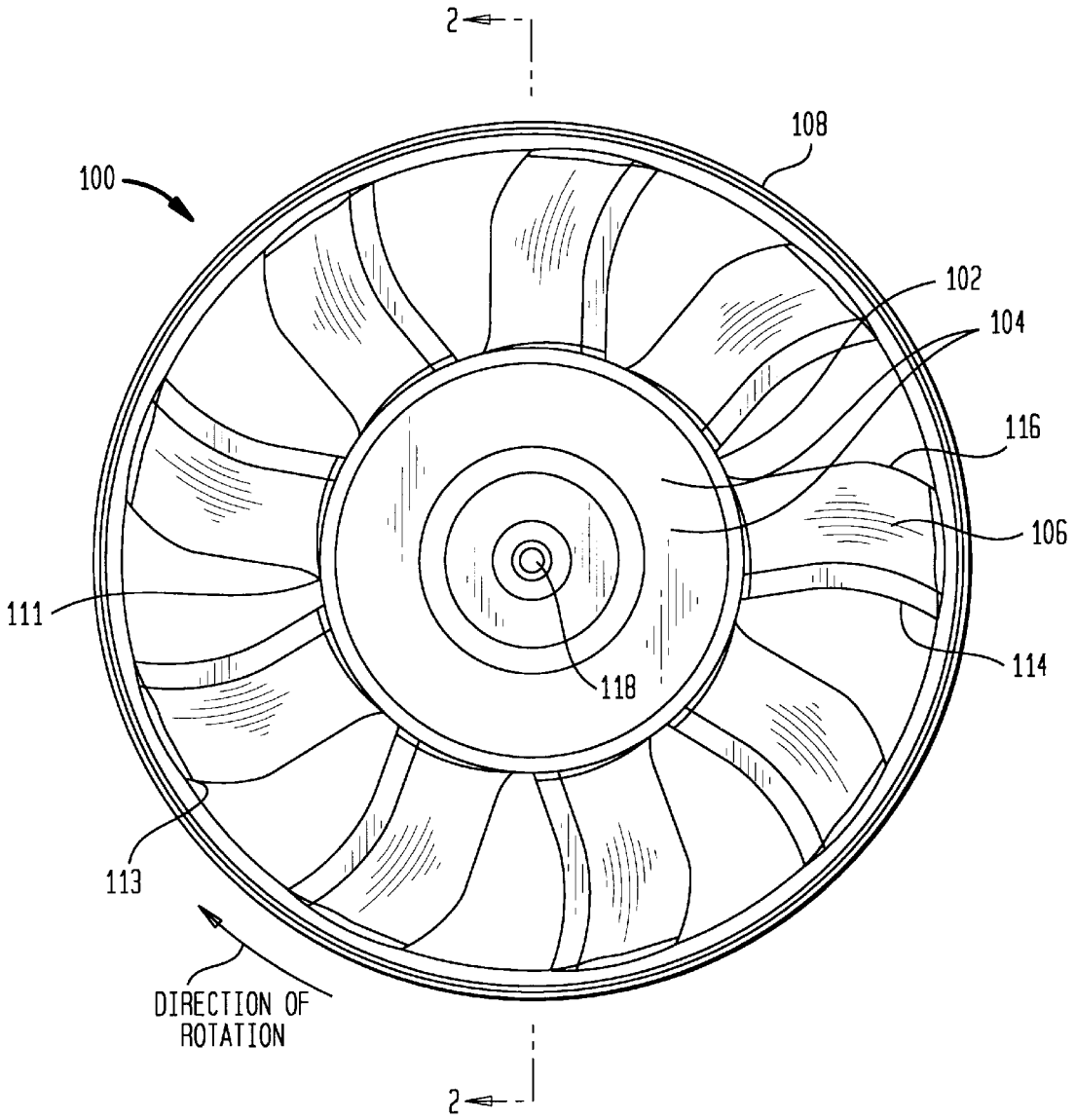
FIG. 1 is a front view of a first embodiment of a fan including a hub, fan blades and a circular band.
Figure 2:
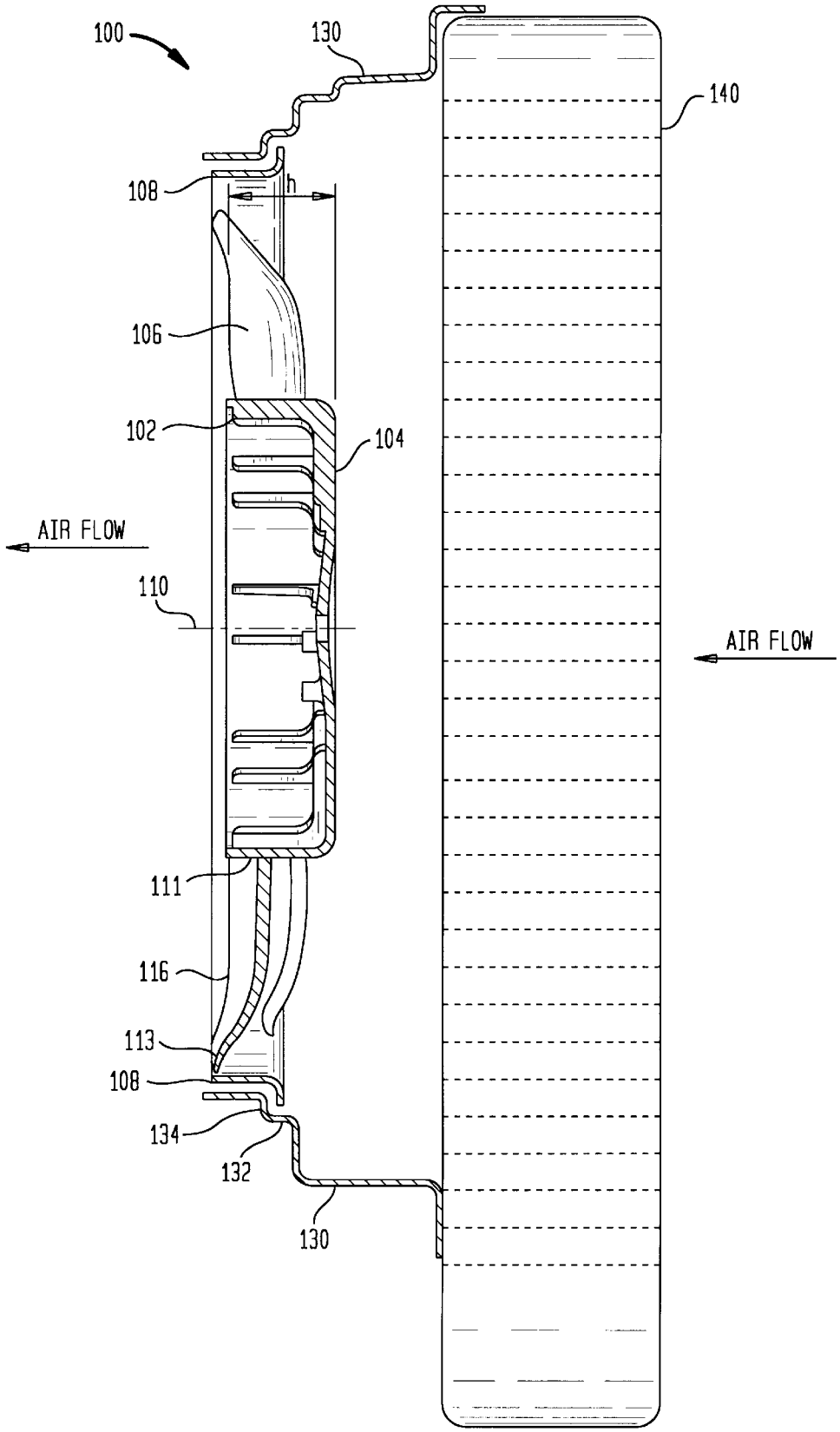
FIG. 2 is a side view in section of the fan shown in FIG. 1 and combined with a heat exchanger.
Figure 3:
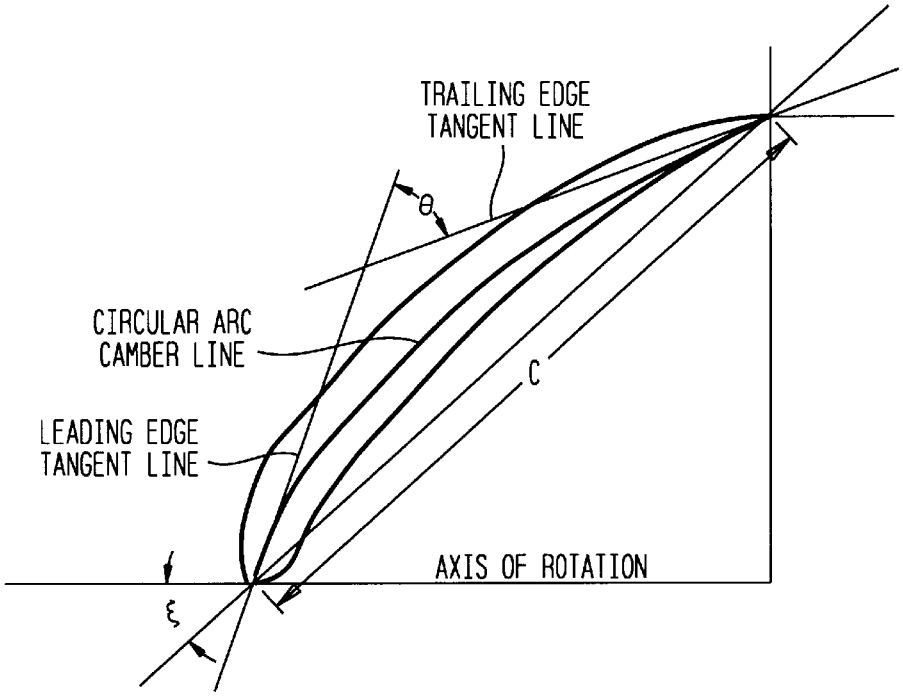
FIG. 3 depicts some of the relationships between and among several of the geometric parameters shown in FIGS. 1 and 2.
Figure 4:
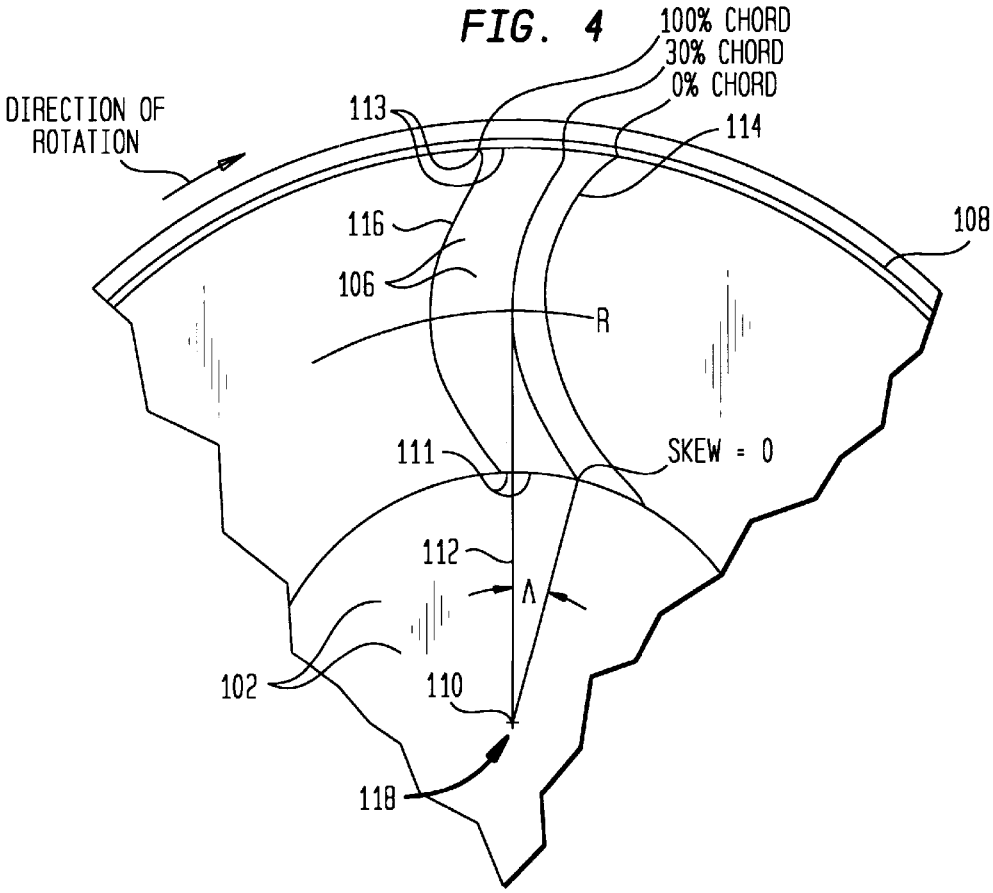
FIG. 4 depicts a portion of a fan and shows how skew is determined.

An embodiment of a fan 100 in accordance with the present invention is shown in FIGS. 1 through 4. Referring to FIGS. 1 and 2, fan 100 is mounted in duct 130 which is attached, and preferably sealed, to heat exchanger 140. Fan 100 includes a circular hub 102, having an upstream surface 104, nine fan blades 106 and a circular band 108. Fan blades 106 each has blade root 111 connected to hub 102 and blade tip 113 connected to band 108. Hub 102 is concentric to a rotational axis 110 and has a radius 112 extending radially from rotational axis 110. Fan blades 106 are distributed circumferentially around hub 102, and are evenly spaced. In some embodiments according to the invention, the blades are spaced unevenly in order to obtain desired efficiencies and to decrease acoustical noise. Blades 106 extend radially from hub 102 to band 108, with the distance between the two ends of blades 106 referred to as blade length. The distance between rotational axis 110 and locations along blades 106 is referred to as blade section radius R. As is shown in FIG. 1, blade section radii R are measured at various distances from axis 110, for example, at arcs B—B, C—C and D—D. Each blade 106 has leading edge 114, trailing edge 116, and a shape configured to produce an airflow when fan 100 is rotated about rotational axis 110.

An important aspect of the invention pertains to the slope of trailing edge 116 of each blade 106 as each blade extends radially and axially away from fan hub 102. This slope can be expressed relative to a datum plane perpendicular to rotational axis 110. As is shown in FIG. 2, the distance h of trailing edge 116 is measured from datum plane A—A which is perpendicular to rotational axis 110 through upstream surface 104 of hub 102. Values of h are measured at distances R to determine slope, or dh/dR. As one of skill in the art will recognize, slope can be measured by other methods also.

In general, fan 100 is supported and securely coupled to a shaft (not shown) passing fully or partially through an aperture 118 in hub 102. Alternatively, the shaft may be securely coupled to fan 100 by other means, such as a screw passing through hub 102 along rotational axis 110 and into the shaft or by a twist-lock or bayonet fitting. The shaft is rotatably driven by a power source (not shown) such as an electric motor or vehicle engine. An appropriate gearing or transmission, such as a belt, chain or direct coupling drive, may couple the power source to the shaft. In the case of an electric motor, the output shaft of the motor may be used also as the shaft for the fan.

As the shaft is rotated about rotational axis 110 by the power source, torque is applied to hub 102, blades 106 and band 108, and fan 100 rotates about rotational axis 110. Upon rotation of fan 100, blades 106 generate an airflow generally in a direction shown by the arrows labeled "AIR FLOW" in FIG. 2. The airflow may serve to remove heat energy from a liquid, such as a coolant, flowing through heat exchanger 140. Fan 100 may be located on the upstream or downstream side of heat exchanger 140 to push or pull air through is the heat exchanger depending upon the requirements of the particular configuration.

Referring to FIG. 2, band 108 is generally an L-shaped circumferential ring concentric with hub 102 and spaced radially outward from hub 102. Band 108 extends axially from hub 102, generally in a downstream direction. As is shown in FIG. 2, band 108 preferably cooperates with duct 130 to form an aeromechanical (labyrinth-type) seal. Duct 130 includes a ring 132 and a circumferential flange 134 to reduce or eliminate undesirable airflow components, such as turbulence and recirculation, between fan 100 and duct 130. Band 108, ring 132 and circumferential flange 134 are concentric to each other when assembled, forming an aeromechanical seal. However, preferably there is no physical contact between band 108 and duct 130.

A fan according to the invention may be mounted in close proximity to a heat exchanger by ways and methods known in the art. One of skill in the art will recognize the advisablilty of mounting the duct of the present invention to a heat exchanger in a sealed manner so that efficiencies are maximized. Similarly, a motor to which the fan is connected may be mounted in a vehicle engine compartment in ways known in the art.

The components of the invention may be constructed of commonly available materials. By way of example only, fan 100 may be an integrally molded piece fabricated from polycarbonate 20% G.F. Hydex 4320, or from mineral or glass reinforced polyaimide 6/6 (e.g., Du Pont Minlon 22C®), or from other composite or plastics known in the art, or from lightweight metals such as aluminum or titanium.

Table I below shows ranges of parameters for fan blades of first embodiments of the invention. Table II shows specific values which fall within the ranges of Table I, for a fan of one embodiment of the present invention.

TABLE I

RANGES OF DIMENSIONS

| R (mm) | C (mm) | Θ (deg) | ξ (deg) | h (mm) | Λ (deg) | Range of R over which dh/dR is measured (mm) | dh/dR (mm/mm) |
|---|---|---|---|---|---|---|---|
| 66.5 | 8.40 to 48.30 | 10.00 to 25.00 | 61.31 to 71.31 | −25.98 | −3.00 to +3.00 | 66.5 to 72.0 | −0.2164 |
| 72.0 | 8.40 to 48.30 | 10.50 to 25.50 | 56.94 to 66.94 | −27.17 | −3.00 to +3.00 | 72.0 to 91.0 | −0.0658 |
| 91.0 | 8.55 to 49.16 | 16.27 to 36.27 | 55.56 to 65.56 | −28.42 | −1.69 to +4.31 | 91.0 to 104.0 | −0.0031 |
| 104.0 | 8.82 to 50.69 | 13.50 to 28.50 | 58.85 to 68.85 | −28.46 | −1.70 to +4.30 | 104.0 to 117.0 | −0.1846 |
| 117.0 | 9.46 to 54.39 | 11.00 to 26.00 | 60.50 to 70.50 | −30.86 | −2.87 to +3.13 | 117.0 to 124.0 | −0.2143 |
| 124.0 | 9.03 to 51.92 | 10.00 to 25.00 | 62.80 to 72.80 | −32.36 | −4.39 to +1.61 | 124.0 to 130.5 | −0.4615 |
| 130.5 | 8.60 to 49.45 | 10.00 to 25.00 | 67.50 to 77.50 | −29.36 | −5.89 to +0.11 | 130.5 to 130.5 | — |

wherein R is the radial distance in millimeters from the rotational axis; C is the chord length in millimeters at the radial distance R; Θ is the blade section camber angle in degrees at the radial distance R; ξ is the blade section stagger angle in degrees at the radial distance R; Λ is the skew angle of the chord section in degrees, at the radial distance R, calculated at 30% chord; h is the dihedral distance in millimeters of the downstream edge of the blade, at the radial distance R, from a datum plane perpendicular to the axis of rotation at the upstream surface of the hub; dh/dR is the slope of the dihedral measured between two adjacent values of R; and where the blade root position at the hub is defined as zero skew, and negative values of dΛ/dR indicate a forward skew.

TABLE II

SPECIFIC BLADE PARAMETERS

| R (m) | C (mm) | Θ (deg) | ξ (deg) | Λ (deg) | h (mm) | Range of R over which dh/dR is measured (mm) | dh/dR (mm/mm) |
|---|---|---|---|---|---|---|---|
| 66.5 | 42.00 | 15.00 | 66.31 | 0 | −25.98 | 66.5 to 72.0 | −0.2164 |
| 72.0 | 42.00 | 15.50 | 61.94 | 0 | −27.17 | 72.0 to 91.0 | −0.0658 |
| 91.0 | 42.75 | 21.27 | 60.56 | 1.31 | −28.42 | 91.0 to 104.0 | −0.0031 |
| 104.0 | 44.08 | 18.50 | 63.85 | 1.30 | −28.46 | 104.0 to 117.0 | −0.1846 |
| 117.0 | 47.30 | 16.00 | 65.50 | 0.13 | −30.86 | 117.0 to 124.0 | −0.2143 |
| 124.0 | 45.15 | 15.00 | 67.80 | −1.39 | −32.36 | 124.0 to 130.5 | −0.4615 |
| 130.5 | 43.00 | 15.00 | 72.50 | −2.89 | −29.36 | — | — |

wherein R is the radial distance in millimeters from the rotational axis, C is the chord length in millimeters at the radial distance R; Θ is the blade section camber angle in degrees at the radial distance R; ξ is the blade section stagger angle in degrees at the radial distance R; Λ is the skew angle of the chord section in degrees, at the radial distance R, calculated at 30% chord; h is the dihedral distance in millimeters of the downstream edge of the blade, at the radial distance R, from a plane perpendicular to the axis of rotation at the upstream surface of the hub; dh/dR is the slope of the dihedral measured between two adjacent values of R; and where the blade root position at the hub is defined as zero skew, and negative values of dΛ/dR indicate a forward skew.

It is known that any fan design can be scaled in size. It can be appreciated that certain parameters of TABLE II can be non-dimensionalized by the span dimension, the distance from the blade tip 113 to the blade root 111. In the fan embodiment defined in TABLE II, the span is 64 mm. TABLE II(i) below shows the non-dimensionalized parameters of % span, chord (C/span), dihedral (h/span) of the fan embodiment of TABLE II.

TABLE II(i)

SPECIFIC BLADE PARAMETERS

| R (m) | % span | C (mm) | C/span | Θ (deg) | ξ (deg) | Λ (deg) | h (mm) | h/span | Range of R over which dh/dR is measured (% span) | dh/dR (mm/mm) |
|---|---|---|---|---|---|---|---|---|---|---|
| 66.5 | 0.00 | 42.00 | 0.6563 | 15.00 | 66.31 | 0 | −25.98 | −0.4059 | 0 to 8.59 | −0.2164 |
| 72.0 | 8.59 | 42.00 | 0.6563 | 15.50 | 61.94 | 0 | −27.17 | −0.4245 | 8.59 to 38.28 | −0.0658 |
| 91.0 | 38.28 | 42.75 | 0.6680 | 21.27 | 60.56 | 1.31 | −28.42 | −0.4441 | 38.28 to 58.59 | −0.0031 |
| 104.0 | 58.59 | 44.08 | 0.6888 | 18.50 | 63.85 | 1.30 | −28.46 | −0.4447 | 58.59 to 78.91 | −0.1846 |
| 117.0 | 78.91 | 47.30 | 0.7391 | 16.00 | 65.50 | 0.13 | −30.86 | −0.4822 | 78.91 to 89.84 | −0.2143 |
| 124.0 | 89.84 | 45.15 | 0.7055 | 15.00 | 67.80 | −1.39 | −32.36 | −0.5056 | 89.84 to 100 | −0.4615 |
| 130.5 | 100.0 | 43.00 | 0.6719 | 15.00 | 72.50 | −2.89 | −29.36 | −0.4588 | — | — |

wherein R is the radial distance in millimeters from the rotational axis, C is the chord length in millimeters at the radial distance R; Θ is the blade section camber angle in degrees at the radial distance R; ξ is the blade section stagger angle in degrees at the radial distance R; Λ is the skew angle of the chord section in degrees, at the radial distance R, calculated at 30% chord; h is the dihedral distance in millimeters of the downstream edge of the blade, at the radial distance R, from a plane perpendicular to the axis of rotation at the upstream surface of the hub; dh/dR is the slope of the dihedral measured between two adjacent values of R; and where the blade root position at the hub is defined as zero skew, and negative values of dΛ/dR indicate a forward skew.

Fans according to the invention confer improved efficiency when compared to fans in the art utilizing other geometries. For example, as the following chart shows, when the pressure vs. flow rate performance curve, (as tested on a plenum chamber built to standard AMCA 210–85) is compared to that of an existing fan used for a similar purpose, that is, such as Siemens Part No. 164-003-001, significant improvements in efficiency and weight are gained.

| | Invention | Reference |
|---|---|---|
| Power [W] | 426.7 | 432.6 |
| Flow Rate [$m^3/s$] | 0.816 | 0.816 |
| Fan Efficiency | 50% | 42% |
| Weight [grams] | 235.6 | 306.0 |

A fan according to the invention may be powered by an electric motor run off of a vehicle electrical system, as in the comparative example above, or by gears as known in the art. The gears may include belts, chains or direct coupling drives (not shown).

Duct 130 extends between heat exchanger 140 and fan 100 and guides an airflow produced by fan 100 past or through heat exchanger 140. Duct 130 provides a mechanical seal for air flowing between fan 100 and heat exchanger 140, thereby increasing the efficiency of the cooling system.

While the embodiments illustrated in the FIGURES and described above are presently preferred, it should be understood that these embodiments are offered by way of example only. For instance, other embodiments may have a different number of fan blades, or may have different parameter values than those listed for the specific fan embodiment described herein. For another example, the accuracy of the parameter values in Tables I and II is not intended to limit the scope of the invention. The invention is not intended to be limited to any particular embodiment, but is intended to extend to various modifications that nevertheless fall within the spirit and scope of the following claims.

What is claimed:

1. A fan rotatable about a rotational axis comprising:

a hub rotatable around the axis wherein the hub comprises an upstream surface and a circumferential surface, and a plurality of fan blades extending radially from the circumferential surface of the hub, the hub and blades being configured to produce an airflow when rotated about the axis, each blade having a chord length distribution, stagger angle and dihedral distribution which varies along the length of the blade, each blade extending axially downstream from the upstream surface of the hub, wherein each blade joins a circular band concentric with the hub and spaced radially outward from the hub, the circular band comprising an upstream edge disposed substantially axially downstream from the upstream surface of the hub, and wherein the rate of change of the dihedral distance of the trailing edge of each blade with respect to a radius of each blade is variable and is substantially between 0 and −0.46.

2. The fan of claim 1, wherein the leading edge of each blade joins the circular band downstream from the upstream edge of the band.

3. The fan of claim 1, wherein there are nine blades spaced evenly around the circumferential portion of the hub.

4. The fan of claim 2, wherein the circular band has a generally L-shaped cross-section taken along a plane passing through the rotational axis.

5. The fan of claim 4, in combination with a duct, the circular band being operatively disposed within the duct such that, when the fan is rotated within the duct, an aeromechanical seal is formed.

6. The fan of claim 5, wherein the hub, blades and circular band are made integral.

7. A high efficiency axial flow fan for producing an airflow through an engine compartment of a vehicle comprising:

a hub rotatable about a rotational axis, a circular band concentric with the hub and spaced radially outward from the hub, and a plurality of fan blades distributed circumferentially around the hub and extending radially from the hub to the circular band, wherein each blade has substantially the parameters defined by

| R (mm) | C (mm) | Θ (deg) | ξ (deg) | h (mm) | Λ (deg) | Range of R over which dh/dR is measured (mm) | dh/dR (mm/mm) |
|---|---|---|---|---|---|---|---|
| 66.5 | 8.40 to 48.30 | 10.00 to 25.00 | 61.31 to 71.31 | −25.98 | 3.00 to +3.00 | 66.5 to 72.0 | −0.21636 |
| 72.0 | 8.40 to 48.30 | 10.50 to 25.50 | 56.94 to 66.94 | −27.17 | −3.00 to +3.00 | 72.0 to 91.0 | −0.06579 |
| 91.0 | 8.55 to 49.16 | 16.27 to 36.27 | 55.56 to 65.56 | −28.42 | −1.69 to +4.31 | 91.0 to 104.0 | −0.00308 |
| 104.0 | 8.82 to 50.69 | 13.50 to 28.50 | 58.85 to 68.85 | −28.46 | −1.70 to +4.30 | 104.0 to 17.0 | −0.18462 |
| 117.0 | 9.46 to 54.39 | 11.00 to 26.00 | 60.50 to 70.50 | −30.86 | −2.87 to +3.13 | 117.0 to 24.0 | −0.21429 |
| 124.0 | 9.03 to 51.92 | 10.00 to 25.00 | 62.80 to 72.80 | −32.36 | −4.39 to +1.61 | 124.0 to 30.5 | −0.461538 |
| 130.5 | 8.60 to 49.45 | 10.00 to 25.00 | 67.50 to 77.50 | −29.36 | −5.89 to +0.11 | — | — |

wherein R is the radial distance in millimeters from the rotational axis; C is the chord length in millimeters at the radial distance R; Θ is the blade section camber angle in degrees at the radial distance R; ξ is the blade section stagger angle in degrees at the radial distance R; Λ is the skew angle of the chord section in degrees, at the radial distance R, calculated at 30% chord; h is the dihedral distance in millimeters of the downstream edge of the blade, at the radial distance R, from a plane perpendicular to the axis of rotation at the upstream surface of the hub; dh/dR is the slope of the dihedral measured between two adjacent values of R; and where the blade root position at the hub is defined as zero skew, and negative values of dΛ/dR indicate a forward skew.

8. The fan of claim 7, wherein the circular band has an L-shaped cross-section taken along a plane passing through the rotational axis.

9. The fan of claim 7, wherein there are nine blades spaced evenly around the circumferential portion of the hub.

10. The fan of claim 7, in combination with a duct, the circular band being operatively disposed within the duct such that, when the fan is rotated within the duct, an aeromechanical seal is formed.

11. The fan of claim 9, wherein the hub, blades and circular band are made integral.

12. A high efficiency axial flow fan for producing an airflow through an engine compartment of a vehicle comprising:

a hub rotatable about a rotational axis, a circular band concentric with the hub and spaced radially outward from the hub, and a plurality of fan blades distributed circumferentially around the hub and extending radially from the hub to the circular band, wherein each blade has substantially the parameters defined by

| R (m) | C (mm) | Θ (deg) | ξ (deg) | Λ (deg) | h (mm) | Range of R over which dh/dR is measured (mm) | dh/dR (mm/mm) |
|---|---|---|---|---|---|---|---|
| 66.5 | 42.00 | 15.00 | 66.31 | 0 | −25.98 | 66.5 to 72.0 | −0.21636 |
| 72.0 | 42.00 | 15.50 | 61.94 | 0 | −27.17 | 72.0 to 91.0 | −0.06579 |
| 91.0 | 42.75 | 21.27 | 60.56 | 1.31 | −28.42 | 91.0 to 104.0 | −0.00308 |
| 104.0 | 44.08 | 18.50 | 63.85 | 1.30 | −28.46 | 104.0 to 117.0 | −0.18462 |
| 117.0 | 47.30 | 16.00 | 65.50 | 0.13 | −30.86 | 117.0 to 124.0 | −0.21429 |
| 124.0 | 45.15 | 15.00 | 67.80 | −1.39 | −32.36 | 124.0 to 130.5 | −0.461538 |
| 130.5 | 43.00 | 15.00 | 72.50 | −2.89 | −29.36 | — | — |

wherein R is the radial distance in millimeters from the rotational axis; C is the chord length in millimeters at the radial distance R; Θ is the blade section camber angle in degrees at the radial distance R; ξ is the blade section stagger angle in degrees at the radial distance R; Λ is the skew angle of the chord section in degrees, at the radial distance R, calculated at 30% chord; h is the dihedral distance in millimeters of the downstream edge of the blade, at the radial distance R, from a plane perpendicular to the axis of rotation at the upstream surface of the hub; dh/dR is the slope of the dihedral measured between two adjacent values of R; and where the blade root position at the hub is defined as zero skew, and negative values of dΛ/dR indicate a forward skew.

13. The fan of claim 12, wherein there are nine blades spaced evenly around the circumferential portion of the hub.

14. The fan of claim 12, in combination with a duct, the circular band being operatively disposed within the duct such that, when the fan is rotated within the duct, an aeromechanical seal is formed.

15. The fan of claim 12, wherein the hub, blades and circular band are made integral.

16. A high efficiency axial flow fan for producing an airflow through an engine compartment of a vehicle comprising:

a hub rotatable about a rotational axis, a circular band concentric with the hub and spaced radially outward from the hub, and a plurality of fan blades distributed circumferentially around the hub and extending radially from blade root at the hub to a blade tip at the circular band, wherein each blade has substantially the parameters defined by

| % span | C/span | Θ (deg) | ξ (deg) | Λ (deg) | h/span |
|---|---|---|---|---|---|
| 0.00 | 0.6563 | 15.00 | 66.31 | 0 | −0.4059 |
| 8.59 | 0.6563 | 15.50 | 61.94 | 0 | −0.4245 |
| 38.28 | 0.6680 | 21.27 | 60.56 | 1.31 | −0.4441 |
| 58.59 | 0.6888 | 18.50 | 63.85 | 1.30 | −0.4447 |
| 78.91 | 0.7391 | 16.00 | 65.50 | 0.13 | −0.4822 |
| 89.84 | 0.7055 | 15.00 | 67.80 | −1.39 | −0.5056 |
| 100.0 | 0.6719 | 15.00 | 72.50 | −2.89 | −0.4588 |

wherein span is a distance from a blade tip to an associated blade root; C is the chord length at a % span; Θ is the blade section camber angle in degrees at a % span; ξ is the blade section stagger angle in degrees at a % span; Λ is the skew angle of the chord section in degrees, at a % span, calculated at 30% chord; h is the dihedral distance of a downstream edge of a blade, at a % span, from a plane perpendicular to the axis of rotation at an upstream surface of the hub.

17. The fan of claim 16, wherein there are nine blades spaced evenly around the circumferential portion of the hub.

18. The fan of claim 16, in combination with a duct, the circular band being operatively disposed within the duct such that, when the fan is rotated within the duct, an aeromechanical seal is formed.

19. The fan of claim 16, wherein the hub, blades and circular band are made integral.

20. A vehicle cooling system comprising:

a heat exchanger configured to transfer heat from a vehicle system; and a powered fan constructed and arranged to move air past the heat exchanger, the fan including a plurality of radially-extending fan blades configured to produce an airflow when rotated about a rotational axis, each blade having a chord length distribution, stagger angle and dihedral distribution which varies along the length of the blade, each blade extending axially downstream from the upstream surface of the hub, wherein each blade joins a circular band concentric with the hub and spaced radially outward from the hub, and wherein the circular band comprises an upstream edge disposed substantially axially downstream from the upstream surface of the hub, and wherein the rate of change of the dihedral distance of the trailing edge of each blade with respect to a radius is variable and is substantially between 0 and −0.46.

21. The cooling system of claim 20, wherein there are nine blades spaced evenly around the circumferential portion of the hub.

22. The cooling system of claim 20, further comprising an electric motor, wherein the fan is rotatably supported and powered by the electric motor.

23. The cooling system of claim 20, further comprising a duct for guiding the airflow past the heat exchanger and into the fan.

24. The cooling system of claim 20, wherein the circular band has an L-shaped cross-section taken along a plane passing through the rotational axis.

25. The cooling system of claim 20, in combination with a duct, the circular band being operatively disposed within the duct such that, when the fan is rotated within the duct, an aeromechanical seal is formed.

26. The cooling system of claim 20, wherein the hub, blades and circular band are made integral.

* * * * *